US005214224A

United States Patent [19]

Comer et al.

[11] Patent Number: 5,214,224

[45] Date of Patent: May 25, 1993

[54] DISPERSING ASPHALTENES IN HYDROCARBON REFINERY STREAMS WITH α-OLEFIN/MALEIC ANHYDRIDE COPOLYMER

[76] Inventors: David G. Comer; W. Kirk Stephenson, both of P.O. Box 87, Sugar Land, Tex. 77487-0087

[21] Appl. No.: 910,230

[22] Filed: Jul. 9, 1992

[51] Int. Cl.[5] ..... C07C 7/20; C10L 1/16; C10L 1/20; C10M 101/04

[52] U.S. Cl. ..... 585/3; 585/12; 585/13; 208/44; 252/56 D

[58] Field of Search ..... 585/3, 12, 13; 208/44; 252/56 D

[56] References Cited

U.S. PATENT DOCUMENTS

| | | | |
|---|---|---|---|
| 2,542,542 | 2/1951 | Lippincott et al. | 252/56 D |
| 3,231,498 | 1/1966 | de Vries | 252/56 |
| 3,511,780 | 5/1970 | Neblett et al. | 252/32.7 |
| 3,523,768 | 8/1970 | Mehmedbasich | 44/393 |
| 3,531,440 | 9/1970 | Mehmedbasich | 260/78.4 |
| 3,560,456 | 2/1971 | Hazan et al. | 260/78.5 |
| 3,694,176 | 9/1972 | Miller | 44/62 |
| 4,151,069 | 4/1979 | Rossi | 208/33 |
| 4,161,452 | 7/1979 | Stambaugh et al. | 252/34 |
| 4,240,916 | 12/1980 | Rossi | 252/56 D |
| 4,416,668 | 11/1983 | Thompson | 44/62 |
| 4,489,194 | 12/1984 | Hayashi | 525/193 |
| 4,548,725 | 10/1985 | Bridger | 252/56 R |
| 4,919,683 | 4/1990 | Nalesnik et al. | 144/347 |
| 5,021,498 | 6/1991 | Stephenson et al. | 524/484 |

FOREIGN PATENT DOCUMENTS

| | | |
|---|---|---|
| 1208423 | 7/1986 | Canada . |
| 263704 | 4/1988 | European Pat. Off. . |
| 302643 | 2/1989 | European Pat. Off. . |
| 306290 | 3/1989 | European Pat. Off. . |
| 307815 | 3/1989 | European Pat. Off. . |
| 343981 | 11/1989 | European Pat. Off. . |
| 356256 | 2/1990 | European Pat. Off. . |
| 360419 | 3/1990 | European Pat. Off. . |
| 382450 | 8/1990 | European Pat. Off. . |
| 2330232 | 1/1974 | Fed. Rep. of Germany . |
| 2446829 | 4/1975 | Fed. Rep. of Germany . |
| 2451047 | 5/1975 | Fed. Rep. of Germany . |
| 2627785 | 1/1977 | Fed. Rep. of Germany . |
| 3730885 | 3/1989 | Fed. Rep. of Germany . |
| 2535723 | 5/1984 | France . |
| 56-065091 | 6/1981 | Japan . |
| 56-167791 | 12/1981 | Japan . |
| 58-222190 | 12/1983 | Japan . |
| 59-008790 | 1/1984 | Japan . |
| 61-016989 | 1/1986 | Japan . |
| 61-296090 | 12/1986 | Japan . |
| 62-018494 | 1/1987 | Japan . |
| 62-236893 | 10/1987 | Japan . |
| 1-318083 | 12/1989 | Japan . |
| 83-03615 | 10/1983 | PCT Int'l Appl. . |

OTHER PUBLICATIONS

Naga, Abou El, et al. *Journal of Chemical Technology*, 35A(5), 1985, pp. 241–247. (abstract)

Andress, H. J., *Journal of the American Chemical Society*, 18(4), 1973, pp. 687–692. (abstract)

Speight, J. G., *The Chemistry and Technology of Petroleum*, 2nd ed., New York: Marcel Dekker, Inc., (no date), pp. 96–97, 405–451.

*Primary Examiner*—Anthony McFarlane

*Assistant Examiner*—Nhat D. Phan

*Attorney, Agent, or Firm*—Robert A. Miller; Daniel N. Lundeen; Andrew S. Pryzant

[57] ABSTRACT

Dispersing asphaltenes in liquid hydrocarbons, particularly formed during the refining of crude petroleum, is disclosed. The dispersant comprises a free radically polymerized copolymer of an α-olefin of from about 10 to about 36 carbon atoms and maleic anhydride wherein the anhydride moieties along the copolymer backbone are substantially unhydrolyzed or otherwise not derivatized. The copolymer has a ratio of α-olefin to maleic anhydride of from about 1:1 to about 1:5 and a molecular weight of from 5000 to about 100,000. Alternatively the dispersant comprises a mixture of the α-olefin/-maleic anhydride copolymer and an alkyl substituted phenol/formaldehyde liquid polymer, such as nonyl phenol/formaldehyde polymer, or a lipophilic/hydrophilic vinylic polymer, such as hydroxyethyl methacrylate/lauryl acrylate copolymer. Also disclosed is a liquid hydrocarbon dispersion containing asphaltenes and 1–100 ppm of the α-olefin/maleic anhydride copolymer.

23 Claims, No Drawings

DISPERSING ASPHALTENES IN HYDROCARBON REFINERY STREAMS WITH α-OLEFIN/MALEIC ANHYDRIDE COPOLYMER

FIELD OF THE INVENTION

The present invention relates to dispersing asphaltenes in hydrocarbon refinery streams with α-olefin/-maleic anhydride copolymer additives.

BACKGROUND OF THE INVENTION

Crude oil and petroleum fractions in transportation, refinery separation and other processing operations often contain asphaltenes. Asphaltenes are naturally occurring in crude oil, characteristically have high molecular weight, are essentially soluble in carbon disulfide, insoluble in n-pentane, and are primarily aromatic but can contain varying amounts of sulfur, oxygen and nitrogen. Unless dissolved and/or effectively dispersed, asphaltenes can accumulate and cause fouling of equipment in which they are present.

Asphaltenes are generally dark brown to black friable solids, without a definite melting point, usually intumescent with decomposition on heating to a carbonaceous residue. They are soluble in liquids having a surface tension above 25 dyn/cm, such as pyridine, carbon disulfide, carbon tetrachloride and benzene; and insoluble in nonpolar liquids having a lower surface tension, such as low-boiling petroleum naphtha, petroleum ether, liquified petroleum gases (e.g. methane, ethane and propane), pentane, isopentane, hexane and the like. Asphaltenes are typically isolated as an insoluble residual from petroleum, heavy oil, and bitumen by the addition of 30 to 40 volumes of a non-solvent such as, for example, n-pentane, n-hexane or n-heptane.

The structure of asphaltenes is complex, including a condensed aromatic nucleus that carries alkyl and alicyclic moieties with hetero elements scattered throughout in various locations.

Chemically, asphaltenes have a typical carbon content varying from about 79 to about 89 percent by weight, and a typical hydrogen content varying from about 6.5 to about 11 percent by weight. The atomic ratio of hydrogen to carbon in asphaltenes is almost always between about 1.0 and 1.3, much lower in contrast to oils (1.5–2.0) and petroleum resins (1.4–1.6). Typical oxygen content varies from about 0.3 to about 4.9 percent by weight, sulfur content from about 0.3 to about 10.3 percent by weight, and nitrogen content from about 0.6 to about 3.3 percent by weight. Asphaltenes generally have a molecular weight higher than oils (250 to 600) and petroleum resins (700–1000), typically from about 2000 to about 8000 as measured by vapor phase osmometry.

The means by which asphaltenes are dispersed in naturally occurring petroleums, i.e. an oil medium, has been the subject of much speculation. By themsleves asphaltenes per se are insoluble in the oil fraction of petroleum, but it is reported that the dispersion of asphaltenes is mainly attributable to the naturally occurring resin fraction of the petroleum, as demonstrated by dispersing asphaltenes in oil only by adding petroleum resins. The aromaticity and the proportion of heteroatoms of the resin are important since resins of low aromaticity and/or low hetero element content are not generally as effective in dispersing the asphaltenes. A likely explanation is that the resins associate with the asphaltenes in the manner of an electron donor-acceptor and there are points of structural similarity between the asphaltenes and resins that have an adverse effect on the ability of the resins to associate with and disperse asphaltenes from a different crude oil.

Further information regarding asphaltenes, resins and oils can be found in Speight, *The Chemistry and Technology of Petroleum,* 2nd ed., New York: Marcel Dekker, Inc., pp. 96–97, and 404–451 which is hereby incorporated by reference herein.

Polymers comprising α-olefins and maleic anhydride are well known. Rossi U.S. Pat. No. 4,240,916 discloses an oil soluble copolymer composed of about equimolar amounts of 1-olefins and maleic anhydride useful as a lubricating oil pour point depressant wherein the 1-olefins are a mixture of $C_{10}$–$C_{14}$ and $C_{20}$–$C_{28}$ monomers. The pour point depressant activity is said to be enhanced by esterification of the copolymer with a $C_1$–$C_4$ alcohol.

Rossi U.S. Pat. No. 4,151,069 discloses olefin-dicarboxylic anhydride copolymers and their ester derivatives having $C_{18}$–$C_{50}$ linear alkyl side chains. The polymers and derivatives are said to be useful in amounts of up to 5 weight percent as filtration aids in low-temperature solvent dewaxing of waxy lubricating oils containing 5–30 weight percent wax.

Similarly, U.S. Pat. No. 3,694,176 to Miller, discloses polymers of ethylene and ethylenically unsaturated dicarboxylic acids, anhydrides or esters as wax crystal modifiers, pour point depressants and dewaxing aids in petroleum oil.

Rossi U.S. patent application, Ser. No. 515,562, filed Oct. 17, 1974, abandoned, discloses that partial alkyl ester-partial amide derivatives of low molecular weight maleic anhydride/1-olefin copolymers are useful in mineral oil lubricants as pour point depressants, viscosity index improvers and sludge inhibitors.

Japanese Kokai 62-018,494 discloses low temperature flow improvers for fuel oils which are copolymers of $C_{20}$–$C_{28}$ α-olefins and maleic anhydride.

U.S. Pat. No. 3,560,456 to Hazan et al. discloses a process for making a copolymer of maleic anhydride and an aliphatic olefin having from 16–18 carbon atoms in the presence of a free radical catalyst and a solvent. The copolymer is precipitated from solution using n-propanol or isopropanol.

U.S. Pat. No. 3,231,458 to de Vries discloses a high molecular weight copolymer of α-olefins of from about 2 to about 20 carbon atoms and diolefins of from about 5 to about 20 carbon atoms reacted with maleic anhydride to form a succinic anhydride-substituted adduct said to have rust inhibiting, dispersing and thickening characteristics in liquid hydrocarbon compositions, such as fuels and lubricants.

U.S. Pat. No. 4,919,683 to Nalesnik, et al. discloses a stabilizer for a middle distillate fuel-oil which is an aromatic polyamine succinimide derivative of an ethylene/$C_3$–$C_{18}$ α-olefin copolymer grafted with maleic anhydride.

U.S. Pat. No. 4,866,135 to Gutierrez et al. discloses a reaction product of a $C_5$–$C_9$ lactone adduct of a maleic anhydride grafted ethylene/$C_3$–$C_{28}$ α-olefin polymer with an N-containing heterocyclic aminoalkyl derivative. The polymeric lactone derivatives are said to be useful as dispersant additives for fuel and lubricating oils.

U.S. Pat. No. 4,548,725 to Bridger discloses a lubricant additive said to reduce low temperature microcrystalline wax formation in hydro-dewaxed stock made by reacting an alcohol with a maleic anhydrideolefin copolymer.

U.S. Pat. No. 5,021,498 to Stephenson et al. discloses the preparation of certain alkyl phenol/formaldehyde and lipophilic-hydrophilic polymers and their use as asphaltene dispersants-inhibitors.

SUMMARY OF THE INVENTION

It has been discovered that asphaltene in crude oil and various refinery process streams can be effectively dispersed using a free radically polymerized copolymer of an α-olefin and maleic anhydride without further derivatization to the corresponding acid, ester, amide, etc.

In one embodiment, the present invention provides a method for dispersing asphaltenes in a liquid hydrocarbon. The method comprises the steps of determining the presence of asphaltenes in a liquid hydrocarbon, and introducing an effective amount of an asphaltene dispersant into the liquid hydrocarbon. The asphaltene dispersant comprises a copolymer of an α-olefin having from about 10 to about 36 carbon atoms and maleic anhydride. The weight ratio of the α-olefin to the maleic anhydride in the copolymer is from about 1:1 to about 1:5. The molecular weight of the copolymer is from about 5000 to about 100,000. The anhydride moieties of the copolymer are preferably substantially unreacted, i.e. non-hydrolyzed, and essentially free of ester and amide moieties. The liquid hydrocarbon is preferably crude oil, reduced crude oil, crude distillate, heavy oil or bitumen. The liquid hydrocarbon is, for example, coker charge, hydrotreater effluent, flashed crude, light cycle oil, or a diesel or naphtha refinery stream. The copolymer dispersant preferably comprises an α-olefin having from about 24 to about 28 carbon atoms, a weight ratio of α-olefin to maleic anhydride of from about 1:1 to about 1:2, and a weight average molecular weight of from about 5000 to about 15,000. The liquid hydrocarbon preferably is non-polar with a surface tension below about 25 dyn/cm.

In another aspect, the present invention provides a dispersant that comprises a mixture of two of more polymers wherein a first polymer comprises a copolymer of an α-olefin and maleic anhydride and a second polymer includes an alkyl substituted phenol-formaldehyde liquid polymer and/or a hydrophilic-lipophilic vinylic polymer. The dispersant mixture preferably comprises from about 50 to about 100 parts by weight of the first polymer and from 0 to about 50 parts by weight of the second polymer. A preferred alkyl substituted phenol-formaldehyde liquid polymer comprises nonyl phenol/formaldehyde or t-butyl phenol/formaldehyde polymer. A preferred hydrophilic-lipophilic vinylic polymer comprises hydroxyethylmethacrylate/lauryl acrylate copolymer.

In another embodiment, the present invention provides a hydrocarbon dispersion. The dispersion comprises a liquid hydrocarbon containing asphaltene particles dispersed therein by an effective amount of a copolymer. The copolymer comprises an α-olefin having from about 10 to about 36 carbon atoms and maleic anhydride, wherein the weight ratio of the α-olefin to the maleic anhydride is from about 1:1 to about 1:5, a molecular weight of the copolymer is from about 5000 to about 100,000. The anhydride moieties of the copolymer are preferably substantially unreacted, i.e. non-hydrolyzed, and the copolymer is preferably substantially free of hydrolyzed anhydride moities and any other products found by reaction of the anhydride moities. The α-olefin preferably has from about 24 to about 28 carbon atoms. The copolymer preferably has a weight ratio of α-olefin to maleic anhydride of from about 1:1 to about 1:2 and a weight average molecular weight of from about 5000 to about 15,000.

As another aspect, the dispersion comprises a mixture of two of more polymers wherein a first polymer comprises a copolymer of an α-olefin and maleic anhydride and a second polymer includes an alkyl substituted phenol-formaldehyde liquid polymer and/or a hydrophilic-lipophilic vinylic polymer. A preferred alkyl substituted phenol-formaldehyde liquid polymer comprises nonyl phenol/formaldehyde or t-butyl phenol/formaldehyde polymer. A preferred hydrophilic-lipophilic vinylic polymer comprises hydroxyethylmethacrylate/lauryl acrylate copolymer.

DETAILED DESCRIPTION OF THE INVENTION

The dispersant of the present invention comprises an as-polymerized copolymer of an α-olefin and maleic anhydride wherein the anhydride moieties along the polymer backbone are preferably substantially intact and not converted into a di-acid, ester, amide or any other anhydride reaction products. In contrast to other uses for polymeric maleic anhydride derivatives wherein the anhydride must generally be converted to an ester or amide derivative, it has been found, quite surprisingly that the copolymer of an α-olefin and maleic anhydride, essentially free of such derivative ester and amide moieties, is very effective in dispersing asphaltenes in a hydrocarbon stream.

Suitable α-olefin monomers have from about 10 to about 36 carbon atoms, preferably from about 18 to about 28 carbon atoms, and most preferably from 24 to about 28 carbon atoms. Examples of such α-olefins include 1-tetradecene, 1-hexadecene, 1-octadecene, 1-eicocene, 1-dococene, 1-tetracocene, 1-heptacocene, 1-triacontene, 1-hexatriacontene, and the like.

The molar ratio of α-olefin to maleic anhydride in the copolymer can be from about 1 to about 5, preferably from about 1 to about 2, and most preferably 1 to about 1.5. The copolymer typically has a molecular weight from about 5000 to about 100,000, preferably from 5000 to about 25,000, and more preferably from about 5000 to about 15,000. The copolymer is preferably essentially free of hydrolyzed anhydride moieties, and particularly ester and partial ester derivatives, amide and partial amide derivatives, or any other anhydride reaction products.

The α-olefin/maleic anhydride copolymer is suitable for use in any asphaltene-containing hydrocarbon liquid or stream. Asphaltenes occur naturally in petroleum. In the production of crude oil, for example, the copolymer can be added to the crude oil stream as it is produced, to inhibit fouling, (or to clean fouled equipment) in subterranean production pumps and lines, as well as surface lines, tanks, pumps and other storage and transportation equipment. In a petroleum refinery, for example, the present dispersant can be used in any hydrocarbon stream wherein asphaltene materials are present. Such solids can potentially precipitate and stick onto the walls and other surfaces of the process equipment, particularly under processing conditions which cause the asphaltenes to dissociate from petroleum resins.

Specific examples of asphaltene-forming streams include crude oil, reduced crude oil and crude distillate streams and refinery streams such as crude unit vacuum tower bottoms, hydrotreater effluent, crude unit preflash tower effluent, hydrocracking unit (HCU) streams, light cycle oil (LCO), diesel and naphtha distillate, and the like.

In the processing of crude oil and various fraction thereof containing asphaltenes, dispersing the asphaltenes or keeping the asphaltenes in a dispersed condition is often desired. However, when the asphaltenes are disassociated from the resins, or if a non-solvent is present, the asphaltenes tend to precipitate. Precipitated asphaltenes can accumulate in lines and foul and/or plug process equipment. The present methodology provides for the addition of the copolymer to an asphaltene-containing hydrocarbon stream to disperse the asphaltenes therein, even in the presence of an asphaltene non-solvent and/or upon disassociation of the asphaltenes from the naturally-occurring resins. The present methodology can alternatively and/or additionally be used to disperse asphaltenes which have already precipatated from the liquid hydrocarbon.

The copolymer is preferably added to an asphaltene-containing stream at a point of relatively low pressure to achieve a substantially uniform concentration of copolymer in the stream. The copolymer can be used as a continuous additive in the stream, or it can be added periodically to facilitate asphaltene removal from process equipment in which it has accumulated.

Dispersions of asphaltenes in hydrocarbon liquids are produced by admixing an effective amount of the copolymer in the liquid hydrocarbon. The copolymer is effective to disperse asphaltenes in the oil, i.e. it prohibits or substantially inhibits build-up of asphaltene deposits in equipment used for storing, pumping, transporting, refining or otherwise processing or handling crude oil or a fraction thereof. The copolymer is used in a concentration of from about 0.1 to about 2000 parts per million of the hydrocarbon stream, preferably from about 0.5 to about 1000 parts per million, more preferably from about 1 to about 100 parts per million, even more preferably from about 1 to about 10 parts per million, and especially from about 1 to about 5 parts per million. Dispersions may be achieved at a stream temperature as low as −10° C. up to 500° C. or more, but preferably from about 0° C. to about 400° C.

The copolymer can be used alone or in combination with one or more additional asphaltene dispersants. Additional asphaltene dispersants include, for example, the alkyl phenol-formaldehyde condensation polymers, (APFP) the hydrophilic-lipophilic vinylic polymer, (HLVP) and/or combinations thereof described in U.S. Pat. No. 5,021,498 which is hereby incorporated herein by reference. Briefly, the APFP has a molecular weight from about 1000 to about 20,000 and the alkyl substituent has from 4 to 24 carbon atoms, the HLVP is a copolymer of $C_{4-24}$ hydrocarbyl acrylate or methacrylate as the lipophilic comonomer and acrylic or methacrylic acid, amide or hydroxyalkyl ester as exemplary hydrophilic comonomers. The APFP/HLVP is exemplified by the nonyl phenolformaldehyde/lauryl acrylate-hydroxyethylmethacrylate polymer mixture at a weight ratio from 10/90 to 90/10, preferably 30/70 to 70/30, wherein the nonyl phenol and formaldehyde are in equimolar proportion, the APFP has a molecular weight of 2000–8000, and the lauryl acrylate and hydroxymethylmethacrylate are in a proportion by weight from 10/90 to 90/10.

In a mixed dispersant system, the α-olefin/maleic anhydride copolymer comprises from about 50 to about 90 percent of the dispersant mixture and the additional dispersant(s) comprises from 10 to about 50 percent of the dispersant mixture.

The α-olefin/maleic anhydride copolymer is preferably prepared by a neat free radical polymerization of the maleic anhydride and the α-olefin. Such polymerizations are known in the art. The copolymerization can be initiated by any free radical producing compound. Examples include peroxides, azo, and the like initiators well known in the art. A preferred initiator is t-butyl perbenzoate. It is known that free radical polymerizations of the α-olefin and maleic anhydride are essentially alternating linear chains of the component monomers. This is different from polymer manufacture via the "ene" reaction wherein an olefin main chain is formed with the maleic anhydride grafted to the chain terminal position.

The amount of initiator to employ depends largely on the reactivity of the initiator chosen at a given reaction temperature. Typically, the initiator concentration is between about 0.001 to about 0.20 moles initiator per mole of maleic anhydride monomer, preferably 0.05 to about 0.10 moles initiator per mole anhydride.

The polymerization temperature may vary between about 20° C. to about 200° C. depending upon the initiator used and the desired properties of the copolymer product. We have found a polymerization temperature of from about 125° C. to about 175° C. to be preferred. The polymerization pressure may vary from under a partial vacuum up to several thousand psi. Atmospheric pressure to about 100 psi is preferred for lower equipment costs and ease of manufacture.

Suitable reaction time is usually sufficient time to substantially completely react the available maleic anhydride. Reaction time is typically from about 1 to about 24 hours.

The reaction medium should be a liquid at the temperature and pressure of the copolymerization reaction. Suitable solvents which can optionally be employed include liquid saturated and aromatic hydrocarbons having from about 6 to about 20 carbon atoms, halogenated hydrocarbons having from about 1 to about 5 carbon atoms and ketones having from about 3 to about 6 carbon atoms. In the practice of the present invention, a neat polymerization reaction is conducted in the heated α-olefin comonomer. Otherwise, it is desirable that a separate reaction solvent be compatible with the end use hydrocarbon stream.

The present invention is further illustrated by way of the following examples.

EXAMPLE 1

An α-olefin/maleic anhydride copolymer was made in a batch reaction as follows: To a clean, dry, oxygen-free reactor vessel, 78.75 parts by weight (out of a total of 100) of $C_{28}$ α-olefin (1-octacocene) was added and heated using steam to 149° C. During the heating step, the reactor was purged using nitrogen to remove any water present in the monomer. Repeated monomer samples were analyzed for water content until the water concentration was shown to be 10 ppm or less. The nitrogen purge was continued until all the initiator was added. Following the purging of any water present, 20.82 parts by weight acid-free maleic anhydride was metered into the reactor under agitation, the reactor was reheated to 149° C., and 0.428 parts by weight t-butyl perbenzoate initiator was metered into the reactor over a time period of 2–3 hours. The reaction temperature was allowed to rise to about 165.5° C. before cooling water was applied to the reaction vessel. The reaction temperature was maintained between 154° C. and 165.5° C. If the temperature exceeded 165.5° C., initiator addition was halted until the temperature dropped to 149° C., then initiator addition was continued. Following the addition of all the initiator, the reaction was continued for 15 minutes or until the viscosity of the solution was >1300 cp or the temperature fell below 149° C. The weight average molecular weight was estimated at between about 10,000 and 20,000. The copolymer was stored under anhydrous conditions until used.

EXAMPLE 2–32

Dispersion tests were conducted on asphaltene obtained from several different refinery sources as set out in Table 1. The Example 1 α-olefin/maleic anhydride copolymer was used as a dispersing agent. In addition, the copolymer was tested in combination with other dispersants or coke suppressing agents for comparison.

TABLE I

| Asphaltene Designation | Source |
|---|---|
| A | Crude unit vacuum tower bottoms |
| B | Crude unit vacuum tower botoms |
| C | Desulfurized residuals taken from residual hydrotreater effluent. |
| D | Crude oil |
| E | Crude stream after the crude unit preflash tower. |

Solid asphaltenes were isolated by precipitation with excess hexane. A stock solution containing the asphaltenes was prepared by dissolving the solid asphaltene precipitate in toluene at a ratio of 1 part solid to 9 parts toluene. Alternatively, if the asphaltenes concentration was high enough, the stream sample was used as is or was diluted with an equal volume of toluene.

A dispersant solution was prepared by dissolving sufficient copolymer or other dispersant in toluene to form a 1 percent solution (by weight). The other dispersants used are listed in Table 2.

TABLE 2

| Dispersant Designation | Composition |
|---|---|
| F | t-butyl phenol/formaldehyde polymer |
| G | nonyl phenol/formaldehyde polymer |
| H | lauryl acrylate/hydroxyethyl methacrylate copolymer |
| I | phosphate ester |
| J | pib succinnate |
| K | alkenyl succinimide |

Tests were run by adding 250 μl of a stock solution to a graduated centrifuge tube containing an appropriate amount of dispersant solution diluted to 10 ml with hexane. After agitation for 60 seconds, the tube was allowed to settle for 2 hours. After settling, the height of any solid material at the bottom of the tube was measured and compared to the height of the settled material in a control sample of stock solution containing no dispersant. Dispersion effectiveness for each test is presented in Table 3 as the difference between the heights of the non-dispersed material expressed as a percentage. Results indicate excellent dispersion activity using the α-olefin/maleic anhydride copolymer.

TABLE 3

| | Composition of Dispersant Additives (ppm) | | | | | | | Asphal- | Dispersed |
|---|---|---|---|---|---|---|---|---|---|
| Ex. | Ex. 1 | Disp. F | Disp. G | Disp. H | Disp. I | Disp. J | Disp. K | tene | (%) |
| 2 | 25 | — | — | — | — | — | — | A | 99.5 |
| 3 | 12.5 | 6.6 | — | — | — | — | — | A | 77.5 |
| 4 | 12.5 | — | 9.1 | — | — | — | — | A | 65.0 |
| 5 | 7.5 | 7.5 | — | — | — | — | — | A | 42.5 |
| 6 | 7.5 | — | 7.5 | — | — | — | — | A | 47.5 |
| 7 | 7.5 | — | — | 7.5 | — | — | — | A | 32.5 |
| 8 | 20 | — | — | — | 40 | — | — | A | 36.4 |
| 9 | 40 | | | | 80 | | | A | 40.0 |
| 10 | 80 | — | — | — | 160 | — | — | A | 45.5 |
| 11 | 15 | — | — | — | — | 10 | — | A | 54.2 |
| 12 | 15 | — | — | — | — | — | 10 | A | 56.9 |
| 13 | 0 | 26.4 | — | — | — | — | — | A | 41.7 |
| 14 | 0 | — | 25.0 | — | — | — | — | A | 46.2 |
| 15 | 0 | 7.5 | 7.5 | — | — | — | — | A | 18.8 |
| 16 | 0 | — | — | 5.0 | — | — | — | A | 18.8 |
| 17 | 0 | 7.5 | — | 7.5 | — | — | — | A | 25.0 |
| 18 | 0 | — | — | — | — | — | 23.7 | A | 10.0 |
| 19 | 0 | — | — | — | 40 | 20 | — | A | 36.4 |
| 20 | 0 | — | — | — | 80 | 40 | — | A | 40.0 |
| 21 | 0 | — | — | — | 160 | 80 | — | A | 45.4 |
| 22 | 0 | — | — | — | 40 | — | 20 | A | 0.0 |
| 23 | 6.25 | — | — | — | — | — | | B | 90.0 |
| 24 | 12.5 | — | — | — | — | — | — | B | 95.3 |
| 25 | 25 | — | — | — | — | — | — | B | 98.8 |
| 26 | 62.5 | — | — | — | — | — | — | B | 99.4 |
| 27 | 12.5 | 12.5 | | | | | | B | 84.8 |
| 28 | 12.5 | | 12.5 | | | | | B | 99.5 |
| 29 | 12.5 | | | 12.5 | | | | B | 25.0 |
| 30 | 20 | | | | 40 | | | B | 100 |
| 31 | 0 | 25.0 | — | — | — | — | — | B | 64.31 |
| 32 | 0 | — | 25.0 | — | — | — | — | B | 74.1 |
| 33 | 0 | — | — | 25.0 | — | — | — | B | 41.2 |
| 34 | 0 | — | — | — | — | — | 25.0 | B | 28.6 |
| 35 | 0 | 12.5 | 12.5 | — | — | — | — | B | 71.1 |

TABLE 3-continued

| Ex. | Composition of Dispersant Additives (ppm) | | | | | | | Asphaltene | Dispersed (%) |
|---|---|---|---|---|---|---|---|---|---|
| | Ex. 1 | Disp. F | Disp. G | Disp. H | Disp. I | Disp. J | Disp. K | | |
| 36 | 25 | — | — | — | — | — | — | C | 99.2 |
| 37 | 0 | — | 36.3 | — | — | — | — | C | 98.7 |
| 38 | 0 | — | — | — | 40.0 | 20.0 | — | C | 99.0 |
| 39 | 0 | — | — | — | — | — | 23.7 | C | 98.3 |
| 40 | 25 | — | — | — | — | | — | D | 93.8 |
| 41 | 0 | 26.4 | — | — | — | — | — | D | 91.2 |
| 42 | 0 | — | 36.3 | — | — | — | — | D | 89.5 |
| 43 | 25 | — | — | — | — | — | — | E | 100.0 |
| 44 | 12.5 | 6.6 | — | — | — | — | — | E | 99.8 |
| 45 | 12.5 | — | 9.1 | — | — | — | — | E | 99.8 |
| 46 | 15 | — | — | — | — | 10 | — | E | 99.8 |
| 47 | 15 | — | — | — | — | — | 10 | E | 99.7 |
| 48 | 0 | 26.4 | — | — | — | — | — | E | 92.8 |
| 49 | 0 | — | 36.3 | — | — | — | — | E | 54.3 |
| 50 | 0 | — | — | — | — | — | 23.7 | E | 92.3 |

The foregoing description of the invention is illustrative and explanatory thereof. Various changes in the materials, apparatus, and particular parts employed will occur to those skilled in the art. It is intended that all such variations within the scope and spirit of the appended claims be embraced thereby.

We claim:

1. A method for dispersing asphaltenes in a liquid hydrocarbon, comprising the steps of:

determining the presence of asphaltenes in an asphaltene-containing liquid hydrocarbon; and introducing an effective amount of a dispersant into the asphaltene-containing liquid hydrocarbon, said dispersant comprising a copolymer of an α-olefin having from about 10 to about 36 carbon atoms and maleic anhydride, wherein the weight ratio of said α-olefin to maleic anhydride is from about 1:1 to about 1:5 and the molecular weight of said copolymer is from about 5000 to about 100,000.

2. The method of claim 1, wherein said asphaltene-containing liquid hydrocarbon comprises crude oil, flashed crude oil, crude distillate, heavy oil or bitumen.

3. The method of claim 1, wherein said asphaltene-containing liquid hydrocarbon comprises crude unit vacuum tower bottoms, hydrotreater effluent, crude unit preflash tower effluent, a hydrocracking unit stream, light cycle oil, diesel or a naphtha distillate refinery stream.

4. The method of claim 1, wherein said liquid hydrocarbon has a surface tension below about 25 dyn/cm.

5. The method of claim 1, wherein said dispersant comprises from about 50 to about 90 parts by weight of said α-olefin/maleic anhydride copolymer and from 10 to about 50 parts by weight of an alkyl substituted phenol/formaldehyde liquid polymer or a hydrophilic/-lipophilic vinylic liquid polymer.

6. The method of claim 5, wherein said alkyl substituted phenol/formaldehyde liquid polymer is selected from the group consisting of nonyl phenol/formaldehyde and t-butyl phenol/formaldehyde polymer.

7. The method of claim 5, wherein said hydrophilic/-lipophilic vinylic liquid polymer comprises hydroxyethyl methacrylate/lauryl acrylate copolymer.

8. The method of claim 1, wherein said asphaltene-containing liquid hydrocarbon comprises from about 1 to 80 parts per million of said copolymer.

9. The method of claim 1, wherein said α-olefin comprises from about 24 to about 28 carbon atoms.

10. The method of claim 1, wherein the weight ratio of said α-olefin to said maleic anhydride is from about 1:1 to about 1:2.

11. The method of claim 1, wherein the copolymer has a molecular weight from about 5,000 to about 15,000.

12. The method of claim 1, wherein said asphaltene-containing liquid hydrocarbon comprises from about 1 to about 25 parts per million of said copolymer.

13. An asphaltene dispersion, comprising:

a liquid hydrocarbon mixture containing asphaltenes; and an effective amount of a copolymer to disperse said asphaltenes therein, said copolymer comprising an α-olefin having from about 10 to about 36 carbon atoms and maleic anhydride, wherein the weight ratio of said α-olefin to said maleic anhydride is from about 1:1 to about 1:5 and the copolymer has a molecular weight of from about 5,000 to about 100,000.

14. The dispersion of claim 13, wherein the hydrocarbon liquid comprises crude oil, flashed crude oil, crude distillate, heavy oil, or bitumen.

15. The dispersion of claim 13, wherein the hydrocarbon liquid comprises crude unit vacuum tower bottoms, hydrotreater effluent, crude unit preflash tower effluent, a hydrocracking unit stream, light cycle oil, or a diesel or naphtha distillate refinery stream.

16. The dispersion of claim 13, wherein said liquid hydrocarbon mixture has a surface tension below about 25 dyn/cm.

17. The dispersion of claim 13, wherein said dispersant comprises from about 50 to about 90 parts by weight of said α-olefin/maleic anhydride copolymer and from 10 to about 50 parts by weight of an alkyl substituted phenol/formaldehyde liquid polymer or a hydrophilic/lipophilic vinylic liquid polymer.

18. The dispersion of claim 13, comprising from about 1 to about 1000 parts per million of said copolymer.

19. The dispersion of claim 13, wherein said α-olefin has from about 18 to about 28 carbon atoms.

20. The dispersion of claim 13, wherein said α-olefin has from about 24 to about 28 carbon atoms.

21. The dispersion of claim 13, wherein the weight ratio of α-olefin to maleic anhydride is from about 1:1 to about 1:2.

22. The dispersion of claim 13, wherein the copolymer has a molecular weight from about 5,000 to about 50,000.

23. The dispersion of claim 13, wherein the copolymer has a molecular weight from about 5,000 to about 15,000.

* * * * *